United States Patent [19]

Moore

[11] Patent Number: 4,617,064

[45] Date of Patent: Oct. 14, 1986

[54] CLEANING METHOD AND APPARATUS

[75] Inventor: David E. Moore, Loveland, Ohio

[73] Assignee: Cryoblast, Inc., West Haven, Conn.

[21] Appl. No.: 636,372

[22] Filed: Jul. 31, 1984

[51] Int. Cl.[4] ..... B08B 7/00

[52] U.S. Cl. ..... 134/7; 134/11; 134/12; 134/13; 51/319; 51/320

[58] Field of Search ..... 134/7, 11, 12, 13; 51/320, 319

[56] References Cited

U.S. PATENT DOCUMENTS

| | | | |
|---|---|---|---|
| 2,665,119 | 1/1954 | Broman | 134/7 |
| 3,344,558 | 10/1967 | Kirkland | 51/428 |
| 3,676,963 | 7/1972 | Rice et al. | 51/320 |
| 3,702,519 | 11/1972 | Rice et al. | 51/320 |

*Primary Examiner*—Andrew H. Metz
*Assistant Examiner*—Sharon T. Cohen
*Attorney, Agent, or Firm*—Frank J. Thompson

[57] ABSTRACT

A particle-blast cleaning apparatus using sublimable carbon dioxide pellets and a high pressure carrier gas. The apparatus includes a body which houses a rotary pellet transport. The transport conveys pellets from a gravity feed storage hopper to a high pressure carrier gas stream for application of the pellets to a discharge nozzle. Leakage of high pressure gas into the rotary transport is inhibited by the application of a force of gas seals which force is derived from carrier gas pressure. The apparatus enables the use of relatively high pressure carrier gas, the complexity and cost of the apparatus and method.

26 Claims, 5 Drawing Figures

CLEANING METHOD AND APPARATUS

BACKGROUND OF THE INVENTION

1. Field of the Invention

This invention relates to a cleaning method and apparatus of the particle-blast type. The invention relates more particularly to an improved method and form of blast cleaning apparatus using particles which sublimate after contact with objects being cleaned.

2. Description of the Prior Art

Particle blast cleaning apparatus is well known in the art. Sandblasting equipment is a known example of this type of apparatus. Particles which sublimate can advantageously be used with this form of equipment. Carbon dioxide particles have been used for this purpose. The principal features of this latter type of apparatus is that by sublimation of the carbon dioxide particles from a solid to a vapor phase, an enviromentally cleaner technique is utilized and the labor and expense of clean up which existed with prior apparatus such as the sandblasting equipment is eliminated.

Prior apparatus of this type has exhibited various disadvantages. In one prior apparatus, the sublimable pellets are formed and are supplied at a receiving station to a transport under a vacuum. The pellets are transported to a discharge station and are discharged into a relatively low pressure carbon dioxide stream at a discharge station for transport to a discharge nozzle. Apparatus of this type is substantially complex, costly, difficult to operate and difficult to maintain.

OBJECTS OF THE INVENTION

Accordingly, it is an object of this invention to provide an improved method and apparatus for particle-blast cleaning using particles which sublimate.

Another object of the invention is to provide apparatus in which the particles are transferred from a hopper to a transport receiving station by a gravity feed means.

Another object of the invention is to provide an apparatus of the type described in which the carbon dioxide particles are transported to a discharge station and discharged into a relatively high pressure gas stream.

Another object of the invention is to provide an apparatus of the type described which experiences little if any loss of the high pressure gas.

A further object of the invention is to provide an apparatus of the type described which inhibits entry of moisture into a particle supply hopper.

Another object of the invention is to provide a relatively noncomplex apparatus for accomplishing the foregoing objectives.

BRIEF DESCRIPTION OF THE DRAWINGS

These and other objects and features of the invention will become apparent with reference to the following specification and to the drawings wherein.

DETAILED DESCRIPTION

Figure 1:
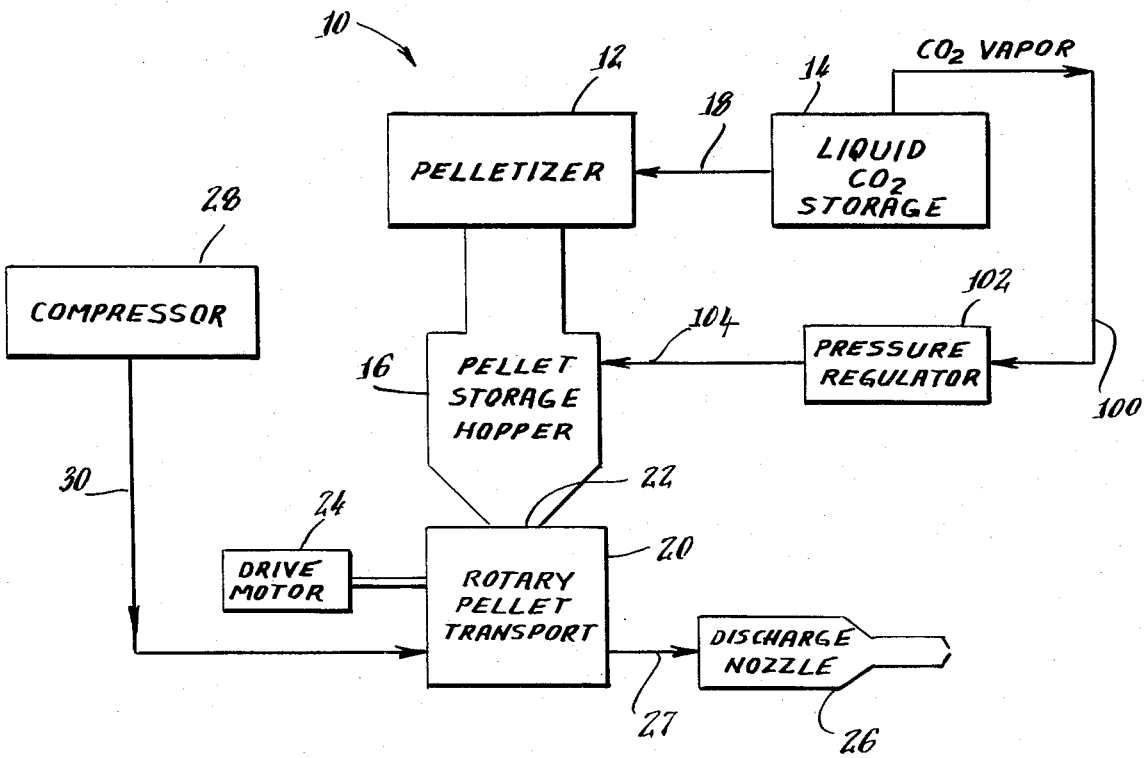
FIG. 1 is a schematic diagram in block form of an apparatus and method for practicing the invention.

Referring now to the drawings, there is shown in FIG. 1 an improved particle-blast, cleaning apparatus

10. The apparatus 10 includes a source of sublimeable pellets. This source includes a pelletizer 12 which extrudes pellets, a source of liquid carbon dioxide 14 and a pellet storage hopper 16. The liquid carbon dioxide which is maintained at about 300 PSI is coupled to the pelletizer 12 through suitable conduit means represented in the drawing by the line 18. The pelletizer is of a known type. In general, the pelletizer comprises a piston assembly and extrusion die. Liquid carbon dioxide upon introduction into the piston cylinder, changes from liquid phase to snow. The snow is compacted by the piston and forced under pressure through a die having a large number of bores formed therein to provide dense carbon dioxide particles. These particles are preferably ⅛ inch in diameter and about 3/16 inches long. The extruded particles thus formed are deposited in the pellet storage hopper 16. A pelletizer of this general type is made by Tomco of Loganville, Ga.

Pellets thus formed are introduced into a rotary pellet transport 20. The pellet storage hopper 16 comprising a gravity supply means vertically orientated with respect to the rotary pellet transport 20 for providing that the pellets flow, by gravity feed, from the hopper 16 to the transport 20 at a receiving station 22. Rotary motion is imparted to a rotary impeller body of the transport 20, discussed hereinafter, by a drive motor 24. Pellets are transported to a discharge station at which location a gas at high pressure conveys the particles from the transport station to a discharge nozzle 26. The gas at high pressure is provided by a compressor 28 via a line 30. This gas, which is preferably air, flows through the transport body and those pellets which are in the path of this stream are carried by the gas to the discharge nozzle 26 over a line 27. The nozzle 26 is manipulated by an operator for projecting the particles at an object for cleaning the object. The particles thus projected by the nozzle will, after impact with the object, sublime from the solid state to the vapor phase state. As a result, cleaning of particle residue, as is necessary with sand blasting equipment, is eliminated thus reducing the labor and cost of the process while at the same time providing an environmentally clean procedure.

Figure 3:
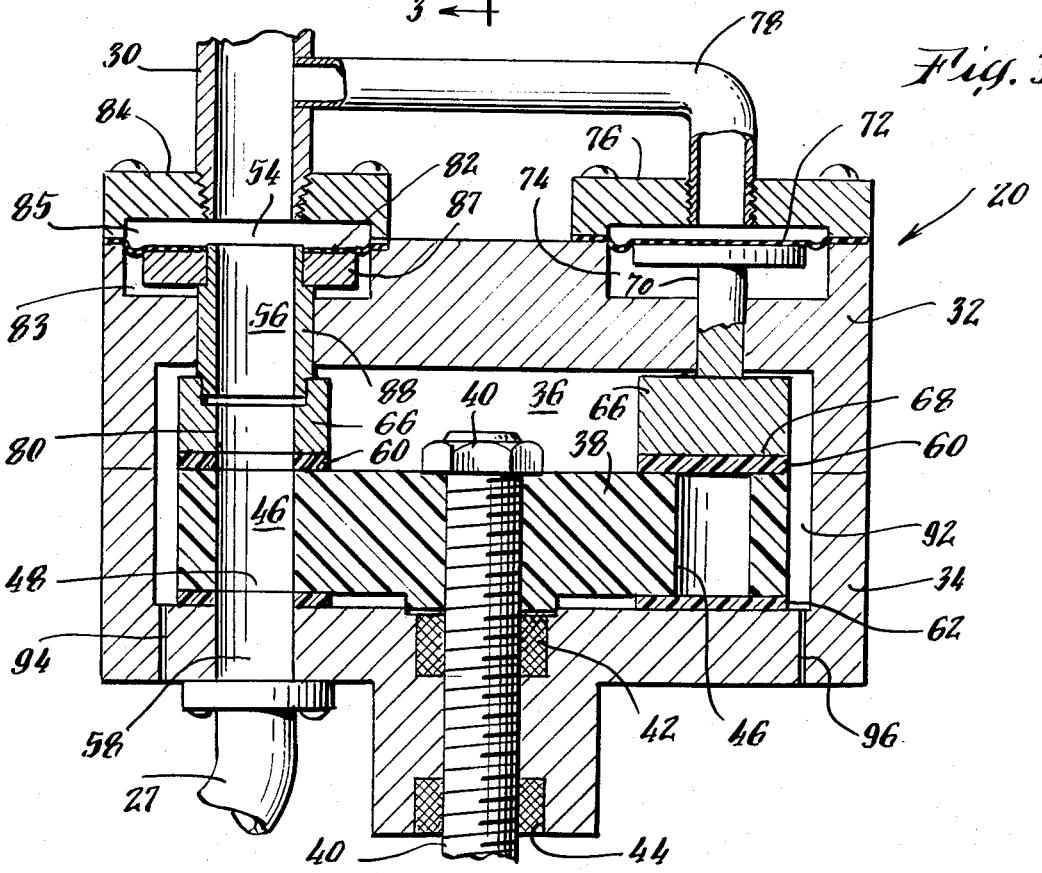
FIG. 3 is a view taken along line 3—3 of FIG. 2.

The rotary pellet transport 20 includes a housing means formed by upper and lower housing members 32 and 34 respectively. These are secured in assembled fashion as illustrated in FIG. 3 by bolts, not illustrated. There is positioned within a cavity 36 of the housing a rotor 38 which is mounted on a drive shaft 40. The shaft 40 is supported in the housing 34 by bearing members 42 and 44. Shaft 40 is coupled to the motor 24 (FIG. 1) either directly or through intermediate couplings such as pulleys and V-belts. The rotor 34 includes a plurality of cavities 46, shown to be bores formed in the body 38, which are uniformly spaced about and centered on a circle of the body 38. Rotation of the drive shaft 40 causes the cavities to rotate in sequence between a receiving station 22 and a discharge station 48 of the housing. A body 50 having a funnel-shaped channel is provided and is positioned between the receiving station 22 and the pellet storage hopper 16 for receiving pellets which flow by gravity into the channel 52 from the pellet storage hopper.

The gas at high pressure is conveyed from the compressor 28 via the conduit 30 to an inlet 54 of the housing member 32. An elongated bore 56 is formed in the member 32 and an elongated bore 58 is formed in member 34 and is in alignment with the bore 56. The rotor 48 is positioned in the housing for providing that the moving cavities 46 successively move into alignment with the bores 56 and 58. Transport gas at high pressure which is introduced at the inlet 54 flows through the bore 56, through the cavity 46 located at the discharge station 48, through the bore 58 and elutes from the housing 34 and flows via the line 27 to the nozzle 26.

A means is provided for inhibiting leakage of transport gas into the receiving station 22 from which it might enter the hopper and carry moisture into it. Because of the relatively low cryogenic temperatures which are encountered in the hopper, any such moisture would freeze and cause undesired coagulation of the particles in the hopper, in the passages to the receiving station, as well as in a transport cavity adjacent the receiving station.

To this end, a means is provided for inhibiting leakage of the high pressure transport gas during its passage through the inlet 54, bore 56, cavity 46 at the receiving station 48, and bore 58. This means comprises a first circular face seal 60, a second circular face seal 62 and a means for establishing a force on the seals for providing an airtight seal between the seals and the rotor 38. A seal backing ring 66 is provided and is positioned adjacent the seal 60. A force is applied to the seal backing ring at a first location 68 adjacent the receiving station 22 by a force transfer rod 70. A force is applied to this rod by a first diaphragm 72. Diaphragm 72 is positioned adjacent the cavity 74 and is maintained in position by a cap 76 which is screw mounted to the housing member 32.

It is desirable that the force applied to the seal 60 be proportional in magnitude with the pressure of the transport gas. As the pressure decreases, less force is necessary to provide an effective seal and the frictional engagement with the rotor 38 can be less. However, as the transport gas pressure increases, the likelihood of leakage of the high pressure gas at the seal increases and under these circumstances, a greater force is preferably applied to the seal. To this end, the transport gas pressure itself is applied to the diaphragm 72 via a tap line 78 which diverts a portion of the gas from the inlet line 30. The tap line is threaded into the cap block 76. A force established on the diaphragm 72 by this gas pressure is applied to the seal 60 via the transfer rod 70 and the seal backing ring 66.

A similar force is also applied to the seal 60 at a second location 80 adjacent the discharge station 48. A second diaphragm 82 is provided and is mounted adjacent a to a cavity 83 in the housing member 32. The conduit 30 is coupled to the housing member 32 by threading into a second cap body 84 which is screw mounted to the housing body 32. The cap includes a recess 85. Transport gas is diverted into the space between the diaphragm in this recess and establishes a force on the diaphragm 82. The force on the diaphragm 82 is applied via a support plate 87, a transfer tube 88 and the seal backing ring 66 to the seal 60 at the second location 80. Accordingly, the force on the seal at location 80 is also proportional to the pressure of the transport gas.

The shaft 40 can be displaced slightly in axial direction thus enabling the forces applied to the seal 60 to force the rotor body 38 into engagement with the seal 62 for establishing a force thereon in accordance with the force applied to the seal 60. As a result, a leakage of high pressure transport gas from its designated channels will be sealed against and is inhibited from leaking to the receiving station and into the hopper. Thus, moisture which might be contained in the high pressure transport gas is inhibited from entry into the hopper 16. Any transport gas which may leak into the intersticies 90 and 92 in the housing is bled therefrom by bores 94 and 96. As a result of this sealing arrangement, a relatively high pressure gas, preferably air, can be utilized for conveying the particles from the discharge station 48 to the nozzle 24. This substantially simplifies both the complexity of the structure and reduces the cost of the apparatus.

Figure 4:
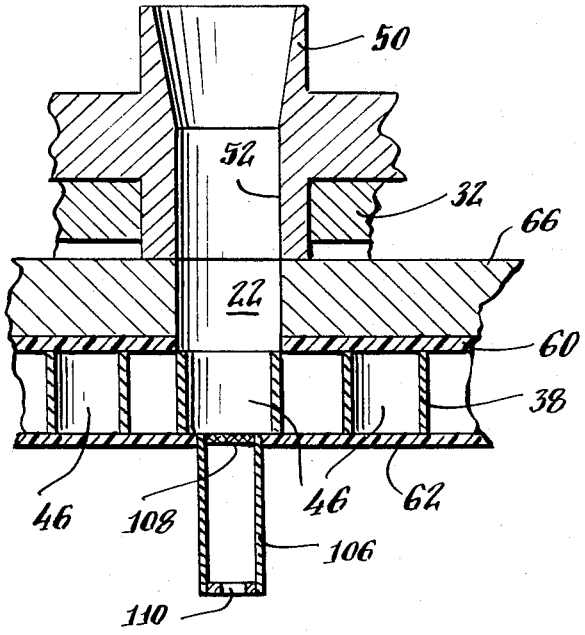
FIG. 4 is a view taken along line 4—4 of FIG. 2.
Figure 5:
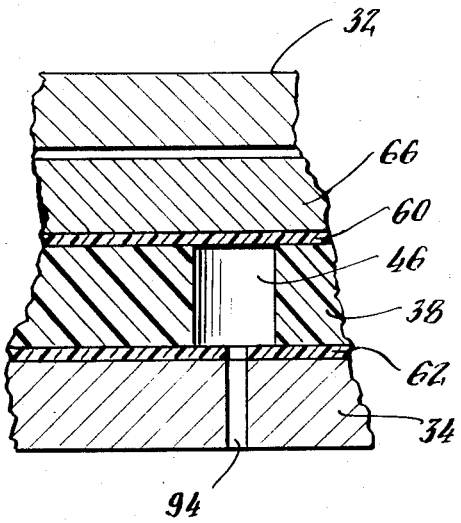
FIG. 5 is a view taken along line 5—5 of FIG. 2.
Figure 2:
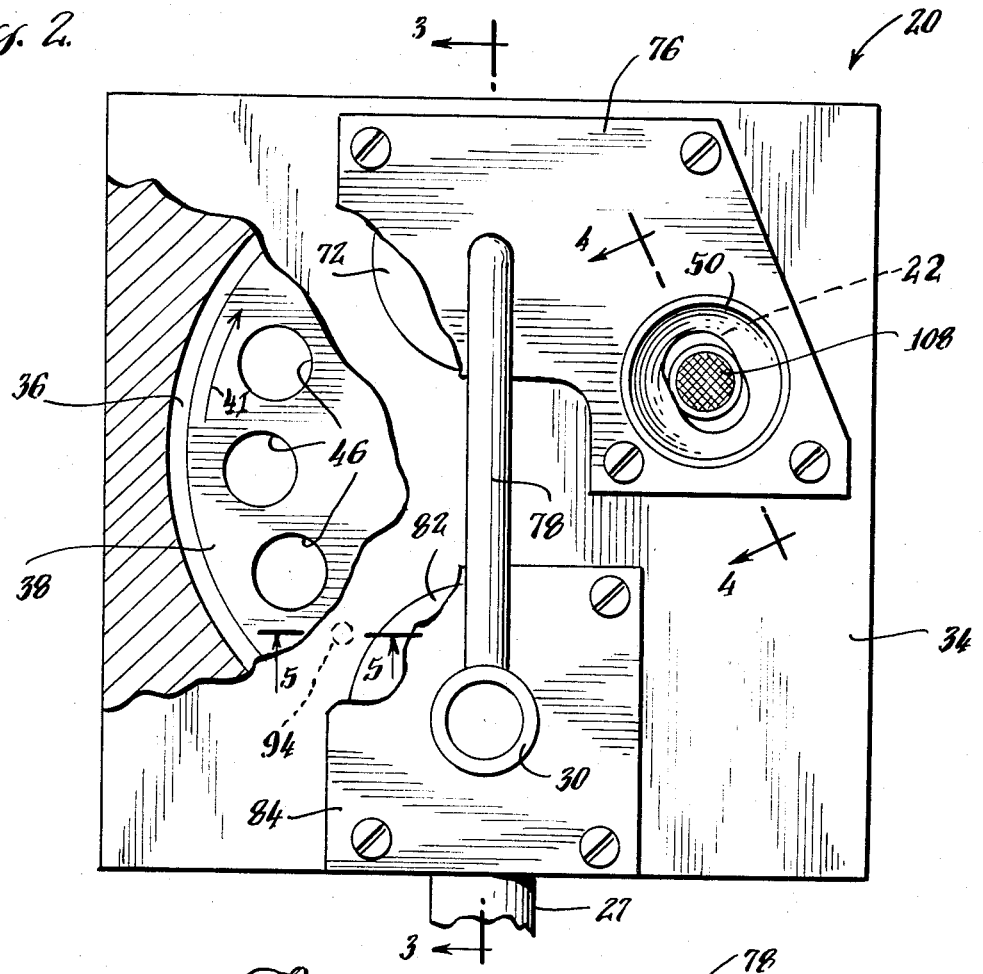
FIG. 2 is a plan view of a housing and transport means of FIG. 1.

Leakage of moisture into the hopper 16 is further inhibited by pressurizing the hopper with carbon dioxide vapor. Referring once again to FIG. 1, it will be seen that carbon dioxide vapor from the liquid storage 14 is conveyed via a line 100 to a pressure regulator 102 which reduces the high pressure to a level suitable for application to the pellet storage hopper 16. While various pressures may be utilized, it is preferable that this pressure should be maintained up to about 2.0 PSI. Referring to FIG. 4, the carbon dioxide vapor in the hopper 16 will flow into a transport cavity 46 at the receiving station 22 and is vented from the transport body housing through a tube 106 which includes a screen 108 and a restriction 110 positioned in the tube.

The structure thus described advantageously enables the use of available standard components at high transport gas pressures which in turn reduces the complexity and cost of the apparatus. While various pressures may be utilized, the term high as used in the specification and claims refers to transport gas pressures greater than about 50 PSI. A preferred range of high pressures is 60 to 250 PSI.

The gravity feed described herein is advantageous since it greatly simplifies the structure and cost of the apparatus required for introducing the carbon dioxide pellets into the rotary transport body. I have found that the gravity feed of the particles at this cryogenic temperature of about −109° F. will operate satisfactorily when the diameter of the transport cavities 48 are at least 10 times the smallest dimension of the sublimeable particles. It is also desirable to minimize the residence time of pellets in the apparatus and to this end, the pellet receiving station 22 is located as close as possible to the high pressure gas air inlet consistent with the transport configuration and fixed passages so as to preclude cross leakage of air from the high pressure passage to the pellet inlet.

There has thus been described an improved method and apparatus for transporting sublimeable pellets from a pellet storage hopper to a discharge nozzle. The described method and apparatus are advantageous in that they substantially reduce the complexity of equipment necessary for its construction, enhance reliability and reduce overall cost.

While I have described a particular embodiment of the invention, it will be apparent to those skilled in the art that variations may be made thereto without departing from the spirit of the invention and the scope of the appended claims.

What is claimed is:

1. An improved particle-blast, cleaning apparatus comprising:

(a) a source of sublimeable pellets;

(b) housing means having pellet receiving and discharge stations;

(c) a rotary transport means having a plurality of cavities for receiving said pellets at said receiving station and transporting said pellets to said discharge station;

(d) means for providing gravity flow of said pellets to a cavity of said rotary transport means at said receiving station;

(e) a discharge nozzle; and, (f) means for supplying a transport gas at high pressure to said discharge station for conveying said pellets from said discharge station to said discharge nozzle.

2. The apparatus of claim 1 wherein said particles are formed of carbon dioxide.

3. The apparatus of claim 1 where said transport gas comprises compressed air.

4. The apparatus of claim 1 including means for inhibiting the entry of moisture into said gravity supply means.

5. The apparatus of claim 4 wherein said means for inhibiting entry of moisture to said gravity supply means comprises a source of carbon dioxide vapor and means for conveying said vapor to said gravity supply means.

6. The apparatus of claim 5 for wherein said carbon dioxide vapor is supplied to said gravity supply means at a pressure of less than 5 psi.

7. The apparatus of claim 6 wherein said carbon dioxide vapor is supplied to said gravity supply means at a pressure greater than atmospheric pressure.

8. The apparatus of claim 5 including means for conveying said carbon dioxide vapor to a cavity of said rotary transport means at said receiving station and for discharging said carbon dioxide from said rotary transport means.

9. The apparatus of claim 1 including means for inhibiting leakage of said high pressure gas into said gravity supply means.

10. The apparatus of claim 9 wherein said rotary transport means includes a rotary body having a plurality of pellet transport cavities formed therein, said body having first and second opposite faces thereof, means for rotating said body for transporting said cavities in sequence between said receiving station and said discharge station, first and second sealing means positioned adjacent said first and second faces respectively for providing an air tight seal against said faces, and means for establishing a force on at least of one said seals.

11. The apparatus of claim 10 wherein said means for establishing a force on said seal establishes a force thereon in proportion to the pressure of said transport gas supplied to said discharge station.

12. The apparatus of claim 11 wherein said force establishing means includes a diaphragm means.

13. The apparatus of claim 12 including a first pressure sensitive diaphragm, means for applying said transport gas to said diaphragm for establishing a force on said diaphragm in accordance with said transport gas pressure and means for applying said force at said diaphragm to said seal.

14. The apparatus of claim 12 wherein said means for applying a force at said diaphragm to said seal comprises a piston which engages said diaphragm and engages said seal at a first location on said seal.

15. The apparatus of claim 14 wherein said first location is adjacent said receiving station.

16. The apparatus of claim 12 including a second pressure sensitive diaphragm, means for establishing a force on said second diaphragm in proportion to said transport gas pressure and means for applying said force at said second diaphragm to said seal at a second location on said seal.

17. The apparatus of claim 16 wherein said second location is adjacent said discharge station.

18. The apparatus of claim 12 including means for supplying said transport gas to said diaphragm means.

19. The apparatus of claim 10 including means for discharging said high pressure gas which leaks into said housing.

20. The apparatus of claim 1 in which the cavities are cylindrically shaped, said pellets have a diameter and said cavity diameter is as least ten times the diameter of said pellets.

21. An improved method for transporting sublimeable pellets in a pellet blast cleaning apparatus comprising the steps of:

(a) rotating a body having a plurality of pellet transport cavities therein between a receiving station and a discharge station;

(b) providing a gravity feed of sublimeable pellets from a supply hopper to a cavity at said receiving station;

(c) rotating said body for transporting said pellets to said discharge station;

(d) flowing a transport gas at high pressure through said cavity at said transport station for discharging said pellets from said cavity; and (e) conveying said pellets to a discharge nozzle.

22. The method of claim 21 wherein said transport gas comprises air.

23. The method of claim 21 including the step of establishing a pressure in said hopper means for inhibiting the leakage of moisture into said hopper.

24. The method of claim 22 wherein said vapor comprises the gaseous phase of said sublimeable particles.

25. The method of claim 22 including the step of flowing said vapor from said hopper means to said receiving cavity at said receiving station and discharging said vapor from said cavity at a location adjacent to said receiving station.

26. The method of claim 21 including the step of applying a force to a seal adjacent said rotary body which is proportional to the pressure of said high pressure gas for inhibiting leakage of said high pressure gas into said hopper.

* * * * *